US007625204B2

(12) United States Patent
Katsumata

(10) Patent No.: US 7,625,204 B2
(45) Date of Patent: Dec. 1, 2009

(54) GAS COOLING TYPE VACUUM HEAT TREATING FURNACE AND COOLING GAS DIRECTION SWITCHING DEVICE THEREFOR

(75) Inventor: Kazuhiko Katsumata, Tokyo (JP)

(73) Assignee: IHI Corporation, Tokyo (JP)

( * ) Notice: Subject to any disclaimer, the term of this patent is extended or adjusted under 35 U.S.C. 154(b) by 385 days.

(21) Appl. No.: 10/562,498

(22) PCT Filed: Mar. 31, 2004

(86) PCT No.: PCT/JP2004/004643

§ 371 (c)(1),
(2), (4) Date: Dec. 27, 2005

(87) PCT Pub. No.: WO2005/001360

PCT Pub. Date: Jan. 6, 2005

(65) Prior Publication Data

US 2007/0122761 A1 May 31, 2007

(30) Foreign Application Priority Data

Jun. 27, 2003 (JP) ..... 2003-183968
Jul. 11, 2003 (JP) ..... 2003-273411

(51) Int. Cl.
*F27B 5/04* (2006.01)

(52) U.S. Cl. ..... 432/77; 432/205

(58) Field of Classification Search ..... 432/77, 432/81, 205, 242, 112–114
See application file for complete search history.

(56) References Cited

U.S. PATENT DOCUMENTS 2,731,127 A 1/1956 Harrison
4,518,353 A 5/1985 Banno et al.
4,560,348 A * 12/1985 Moller et al. ..... 432/77
4,610,435 A * 9/1986 Pfau et al. ..... 266/250
4,836,776 A * 6/1989 Jomain ..... 432/205
4,854,863 A 8/1989 Hemsath
4,932,864 A 6/1990 Miyabe
4,963,091 A * 10/1990 Hoetzl et al. ..... 432/205
5,035,610 A * 7/1991 Hoetzl et al. ..... 432/77

(Continued)

FOREIGN PATENT DOCUMENTS

CN 1426484 A 6/2003

(Continued)

OTHER PUBLICATIONS

Katsuhiro Yamazaki, Vacuum Heat Treatment, Heat-Treatment vol. 1, No. 2, pp. 110-115, 1990.

(Continued)

*Primary Examiner*—Gregory A Wilson
(74) *Attorney, Agent, or Firm*—Griffin & Szipl, P.C.

(57) ABSTRACT

A gas cooling type vacuum heat-treating furnace according to the present invention, includes a gas cooling furnace comprising a cooling chamber in which an article to be heat-treated is stationarily set, and defining therein a gas passage in a vertical direction, a gas cooling and circulating device for cooling and circulating gas flowing in the cooling chamber, a gas direction switching device for alternately changing over directions of gas vertically passing through the cooling chamber, and upper and lower straighteners blocking upper and lower ends of the cooling chamber, for causing a velocity distribution of the gas to be uniform.

7 Claims, 10 Drawing Sheets

U.S. PATENT DOCUMENTS

| | | | | |
|---|---|---|---|---|
| 5,052,923 | A | 10/1991 | Peter et al. | |
| 5,290,189 | A | 3/1994 | Hemsath et al. | |
| 5,443,383 | A | 8/1995 | Kuehn | |
| 6,530,780 | B2 | 3/2003 | Mori et al. | |
| 6,821,114 | B2 * | 11/2004 | Kisoda | 432/81 |
| 7,090,488 | B2 | 8/2006 | Murakami et al. | |
| 2007/0172786 | A1 * | 7/2007 | Katsumata | 432/206 |
| 2007/0212657 | A1 * | 9/2007 | Katsumata et al. | 432/77 |

FOREIGN PATENT DOCUMENTS

| | | | | | |
|---|---|---|---|---|---|
| DE | 3215509 | A1 | * | 10/1983 | 432/205 |
| EP | 0 422 353 | A2 | | 4/1991 | |
| EP | 1 475 446 | A1 | | 11/2004 | |
| EP | 1 643 199 | A1 | | 4/2006 | |
| EP | 1 801 529 | A1 | | 6/2007 | |
| GB | 2 117 880 | A | | 10/1983 | |
| JP | 61-15079 | A | | 1/1986 | |
| JP | 01176023 | A | * | 7/1989 | 432/205 |
| JP | 5-001887 | A | | 1/1993 | |
| JP | 5-230528 | A | | 9/1993 | |
| JP | 8-295926 | | | 11/1996 | |
| JP | 8-327420 | | | 12/1996 | |
| JP | 2731127 | | | 12/1997 | |
| JP | 11-153386 | A | | 6/1999 | |
| JP | 2002333277 | | | 11/2002 | |

OTHER PUBLICATIONS

International Search Report (PCT/ISA/210), completed Jul. 1, 2004.

Supplemental European Search Report issued in corresponding application No. EP04724762.2, completed Nov. 4, 2008 and mailed Nov. 11, 2008.

* cited by examiner

GAS COOLING TYPE VACUUM HEAT TREATING FURNACE AND COOLING GAS DIRECTION SWITCHING DEVICE THEREFOR

This is a National Phase Application in the United States of International Patent Application No. PCT/JP2004/004643 filed Mar. 31, 2004, which claims priority on Japanese Patent Application No. 2003-183968, filed Jun. 27, 2003 and Japanese Patent Application No. 2003-273411, filed Jul. 11, 2003. The entire disclosures of the above patent applications are hereby incorporated by reference.

BACKGROUND OF THE INVENTION

1. Technical Field of the Invention

The present invention relates to a gas cooling type vacuum heat treating furnace and a cooling gas direction switching device therefor.

2. Description of the Related Art

A vacuum heat treating furnace is the one in which inert gas or the like is refilled after depressurization therein in order to carry out heat-treatment of an article. Since the vacuum heat treating furnace may completely remove moisture or the like sticking to the interior of the furnace and to the treated article after heating, by depressurizing again the furnace after evaporation of the moisture or the like, and refilling the inert gas or the like thereinto, there may be exhibited such an merit that heat-treatment may be made without coloring by moisture (the so-called bright heat-treatment).

Further, a gas cooling type vacuum heat treating furnace may exhibit various merits such as capability of performing bright heat-treatment, causing no decarbonization, carburization and less deformation, and effecting a satisfactory working environment. However, a primary stage gas cooling type vacuum heat treating furnace was of a depressurizing and cooling type, and accordingly, its cooling speed was not sufficiently high so as to be disadvantageous. Thus, in order to increase the cooling speed, a high speed circulation gas cooling type one has been materialized.

Referring to FIG. 1 which shows a configuration of a high speed circulation gas cooling furnace disclosed in a non-patent document 1, there are shown a heat-insulating member 50, a heater 51, an effective operation zone 52, a furnace body 53 with a water jacket, a heat-exchanger 54, a turbo-fan 55, a fan motor 56, a cooling door 57, a hearth 58, a gas distributor 59, a damper 60 for switching flowing directions (air flow passage) of cooling gas.

Further, "Method of Promoting Gas Circulation Cooling in a Vacuum Furnace" (patent document 1), discloses a vacuum furnace comprising a heating chamber 66 surrounded by heat insulation walls 67 within a gas-tight vacuum vessel 61, as shown in FIG. 2, a heater 72 located in the heating chamber, for heating, under vacuum, an article 64 to be heated, and a cooler 62 and a fan 63 which are provided in the vacuum vessel 61, for cooling unoxidized gas fed into the vacuum vessel by the cooler 62 and then circulating the unoxidized gas in the heating chamber 66 through openings 68, 69 formed in the surfaces of those of the heat insulation walls 67 of the heating chamber 66 which are opposed to each other, by rotating the fan 63 in order to cool the article 64 to be heated under forced gas circulation, wherein a heat-resistant cylindrical hood 65 which is diverged at least at one end thereof, is arranged so as to surround the circumference of the article 64 to be heated which is located in the heating chamber 66, with a suitable space therebetween while opposite ends of the cylindrical hood 68 are opposed respectively to the openings 68, 69 in order to circulate the unoxidized gas through the heating chamber 66. Further, there is shown, in FIG. 2, a damper 40 for switching the flowing directions of the cooling gas.

[Non-patent document 1]

"Vacuum Heat Treatment for Metal Material (2)" authored by Katsuhiro Yamazaki, Heat-Treatment Vol. 30 No. 2, April in 1990

[Patent document 1]

Japanese Patent Laid-Open NO. 5-230528

The high speed circulation gas cooling furnaces disclosed in the non-patent document 1 and the patent document 1 have raised the following problems since the heating and cooling have been carried out at one and the same position:

(1) The heater and the furnace body which are at a high temperature after completion of heating are both cooled simultaneously with cooling of the article to be heat-treated, and accordingly, high speed cooling for the article to be heat-treated cannot be made;

(2) The article to be heat-treated is surrounded by the heater and the furnace body, and accordingly, cooling gas cannot be uniformly fed thereto during cooling;

(3) Even though the gas cooling is made alternately upward and downward, there are no means for rectifying both upward gas and downward gas so as to flow in uniform directions at uniform speeds, and accordingly, it has been difficult to reduce distortion of an article to be heat-treated in its entirely.

Further, in the high speed circulation gas cooling furnaces as disclosed in the non-patent document 1 and the patent document 1 as stated above, upper and lower damper units are in general provided as a mechanism for switching between upward and downward directions of gas flow (passages). However, in the case of using the upper and lower damper units as a cooling gas direction change-over mechanism, there have been raised the following problems:

(4) The damper units cause considerable variation in load exerted by a pressure of gas flowing at a high speed, depending upon an open and a close position thereof. Thus, in the case of high pressure gas, it is difficult due to affection by the pressure of air to smoothly operate such a damper system.

(5) The damper units have an opening area which is not proportional to an opening angle. Thus, upon switching of a plurality of upper and lower drive devices, it is difficult to balances opening areas in order, resulting in a difference in opening area between a suction port and a discharge port and considerable variation in the difference, and accordingly, the quantity of cooling gas varies so as to cause stable gas cooling to be difficult.

(6) There are presented a plurality of upper and lower damper units, and accordingly, a plurality of drive devices therefor are required, resulting in a complicated configuration.

(7) The opening areas are limited by the upper and lower dampers so as to be small in comparison with the interior surface of the furnace.

SUMMARY OF THE INVENTION

The present invention is devised in order to solve the above-mentioned problems, and accordingly, a first object of the present invention is to provide a gas cooling type vacuum heat treating furnace which can cool an article to be heat-treated upon cooling at a high speed in a uniform supply of cooling gas to the article in its entirety, and which can also straighten both upward and downward cooling gases at a uniform speed in uniform directions so as to reduce distortion of the article in its entirety.

Further, a second object of the present invention is to provided a cooling gas direction switching device in a gas cooling type vacuum heat treating furnace, which may smoothly switch flowing directions (passages) of gas with substantially no affection by a pressure of the gas, which may carry out stable gas cooling with substantially no variation in opening area and no difference in opening area between a suction port and a discharge port, which may have a simple configuration so as to be driven by a single drive unit, and which can ensure a large opening area.

In order to achieve the first object of the present invention, according to a first aspect of the present invention, a gas cooling type vacuum heat-treating furnace incorporating a gas cooling furnace for cooling an article which has been heated, with circulation gas, characterized in that the above-mentioned gas cooling furnace comprises a cooling chamber surrounding a cooling zone in which the article to be heat-treated is stationarily set, and defining therein a gas passage having a uniform cross-sectional area in a vertical direction, a gas cooling and circulating device for cooling gas passing the cooling chamber in the vertical direction, and circulating the gas, a gas direction switching device for alternately switching directions of gas flowing vertically, and upper and lower straighteners which block an upper end and a lower end of the cooling chamber so as to obtain a uniform velocity distribution of the gas passing therethrough.

With the first aspect of the present invention in which the upper and lower straighteners block the upper end and the lower end of the cooling chamber so as to obtain an uniform velocity distribution of gas passing therethrough, it is possible to minimize variation in the flowing velocity of the gas passing through the cooling zone, and accordingly, the cooling gas may be blown onto the article with less turbulence. Further, since the cooling gas may be uniformly discharged through an outlet opening after the gas passed through the article, there may be exhibited such an enforcement that the cooling gas is uniformly led through the center part of the article, thereby it is possible to reduce distortion of the article to be treated as a whole.

According to a second aspect of the present invention, in the configuration of the first aspect of the present invention, each of the upper and lower straighteners comprise an uniform distribution part and a straightening part which are stacked one upon another, or incorporate functions of both uniform distribution part and straightening part, the uniform distribution part incorporating a plurality of pressure loss inducing means which are arranged in a direction orthogonal to a flowing direction of upward gas, for applying a flow resistance so as to cause the upward gas to have a pressure loss factor of not less than 0.1 in order to aim at uniformly distributing the flowing velocity of the upward gas, and the straightening part incorporating a plurality of straightening grids for straightening the flowing direction of the upward gas having passed through the uniform distribution part.

With the configuration of the second aspect of the present invention, the plurality of pressure loss inducing means cause the distribution of the flowing velocity to be uniform, and the plurality of straightening grids cause the flowing direction of the gas to be uniform.

According to the third aspect of the present invention, which is a preferred embodiment of the first aspect of the present invention, auxiliary distribution mechanisms for guiding the flowing direction of the gas flowing into and out from the cooling chamber are provided in the upper and lower parts of the cooling chamber.

With the configuration of the third aspect of the present invention in which the auxiliary distribution mechanisms (for example, blow-in vanes), the flowing directions of the gas directed to a plurality of positions are optimized even though the upper and lower areas of the cooling chamber are large, thereby it is possible to enhance the uniformity of the flow.

According to the fourth aspect of the present invention, which is a preferred embodiment of the first aspect of the present invention, the gas cooling and circulating device comprises a cooling fan arranged adjacent to the cooling chamber, for sucking and pressurizing gas which has passed through the cooling chamber and a heat-exchanger for indirectly cooling the gas which is sucked into the cooling fan, and the gas direction switching device comprises a hollow cowling surrounding the heat-exchanger and spaced therefrom, and a lift cylinder for moving the cowling up and down, the cowling having a lower suction port which is communicated with the lower part of the cooling chamber at its downward position, and an upper suction port which is communicated with the upper part of the cooling chamber at its upward position.

With the configuration of the fourth aspect of the present invention in which the lower suction port and the upper suction port are alternately communicated with the suction side of the cooling fan by means of the gas direction switching device, the flowing directions of the gas passing through the cooling chamber in the vertical direction may be alternately switched. Due to the switching, the difference in cooling speeds depending upon positions of articles to be cooled which are arranged in order, may be reduced, thereby it is possible to reduce distortions of the article in its entirety.

In order to achieve a second object of the present invention, according to a fifth aspect of the present invention, there is provided a cooling gas direction switching device for a gas cooling type vacuum heat treating furnace comprising a cooling chamber surrounding a cooling zone in which an article to be heat-treated is stationarily set and a gas cooling and circulating device, for cooling an article which has been heated, with pressurized circulation gas, characterized by a stationary partition plate partitioning between the cooling chamber and the gas cooling and circulating device, a rotary partition plate adapted to be rotated along an outer surface of the stationary partition plate, the stationary partition plate having an opening piercing through the partition plate over a substantially entire surface thereof, the rotary partition plate having a suction opening and a discharge opening partly communicated with a suction port and a discharge port of the gas cooling circulation device, and characterized in that flowing directions of cooling gas passing through the cooling chamber are alternately changed over.

With the configuration of the fifth aspect of the present invention which only has the rotary partition plate rotated along the outer surface of the stationary partition plate that partitions between the cooling chamber and the gas cooling and circulating device, since the flowing directions of the gas passing through the cooling chamber may be alternately switched and since the rotary partition plate is rotated perpendicular to the flowing direction, the air passages may be smoothly switched without less affection by air pressure even though high pressure gas (high density gas medium) is used.

Further, since the rotary partition plate has the suction opening and the discharge opening which are partly communicated with the suction port and the discharge port of the gas cooling and circulating device, variation in opening area and difference in opening area between the suction port and the discharge port can hardly occur, and stable gas cooling may be made. Further, since the configuration is simple, the switching may be made by a single drive device, and further, a large opening area may be ensured.

According to a sixth aspect of the present invention, which is a preferred embodiment of the fifth embodiment of the present invention, the cooling chamber has a gas passage extending therethrough in a vertical direction, and an opening position is set such that the suction opening is communicated only with the lower part of the cooling chamber while the discharge opening is communicated only with the upper part of the cooling chamber when the gas flows downward in the cooling chamber, but the suction opening is communicated only with the upper part of the cooling chamber while the discharge opening is communicated only with the lower part of the cooling chamber when the gas flows upward in the cooling chamber.

With the configuration of the sixth aspect of the present invention, of an interior surface A of the furnace body which partitions between the cooling chamber and the gas cooling circulation device, halves are allocated respectively to the suction port and the discharge port of the gas cooling circulation device, and further, haves of each of the suction port and the discharge port are allocated respectively to an upper part and a lower part, thereby the suction opening and the discharge opening may be set to about quarters of the interior area A of the furnace body, respectively. Accordingly, the air passage may have a large area in comparison with the conventional one, thereby it is possible to reduce the flowing velocity of the gas passing through the cooling chamber, resulting in decreased pressure loss.

Further, since a inside area in the gas cooling furnace is communicated with the suction port of the gas cooling circulation device between the stationary partition plate and the gas cooling and circulating device while only the outside area in the gas cooling furnace is communicated with the discharge port of the gas cooling and circulating device, with a sufficient large gap between the discharge port and the suction port, the gas may flow around onto opposite surfaces even though the opening is made only by a half area, thereby it is possible to effectively use the heat-exchanger in its entirety.

According to a seventh aspect of the present invention, which is a preferred embodiment of the fifth embodiment of the present invention, an opening position is set such that the suction opening is selectively communicated with the lower part or the upper part of the cooling chamber while the discharge port is selectively communicated with the upper part or the lower part of the cooling chamber when the gas flows upward or downward in the cooling chamber, and the suction opening is selectively communicated with only one of opposite sides of the cooling chamber while the discharge opening is selectively communicated with only the other one of the opposite sides of the cooling chamber when the gas flows in a horizontal direction in the cooling chamber.

With the configuration of the seventh aspect of the present invention, with only the provision of the rotary partition plate which is rotated along the outer surface of the stationary partition plate partitioning between the cooling chamber and the gas cooling circulation device, the flow of the gas passing through the cooling chamber may be optionally switched between the upward and downward directions and between the leftward and rightward directions.

According to an eighth aspect of the present invention, which is a preferred embodiment of the fifth aspect of the present invention, the gas cooling and circulating device is composed of a cooling fan arranged adjacent to the cooling chamber, for sucking and pressurizing the gas having passed through the cooling chamber, and a heat-exchanger for indirectly cooling the gas discharged from the cooling fan.

With the configuration of the eighth aspect of the present invention in which between the stationary partition plate and the gas cooling and circulating device, the inside area in the gas cooling furnace is communicated with the suction port of the gas cooling and circulating device while only the outside area in the gas cooling furnace is communicated with the discharge port of the gas cooling and circulating device, a sufficient gap is taken between the discharge port and the suction port so that the gas may flow around onto the opposite surfaces although the opening is made in only a half area, thereby it is possible to effectively use the heat-exchanger in its entirety.

Other objects and features of the present invention will be apparent when the following explanation will be read with reference to the accompanying drawings.

BRIEF DESCRIPTION OF THE INVENTION

FIGS. 4A and 4B are collectively referred to herein as FIG. 4;

DESCRIPTION OF PREFERRED EMBODIMENT OF THE INVENTION

Figure 1:
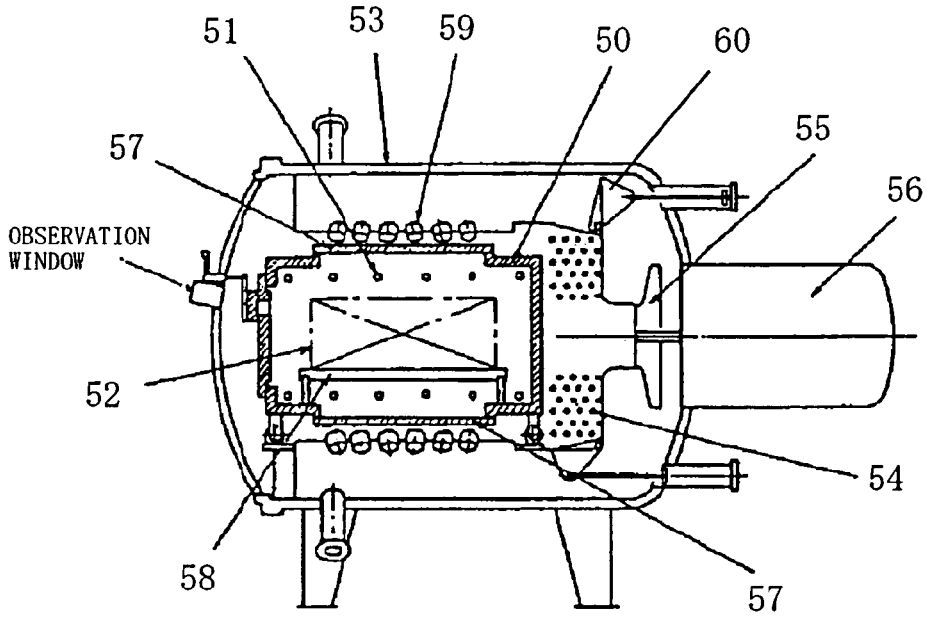
FIG. 1 PRIOR ART
FIG. 1 is a view illustrating a configuration of a high speed circulation gas cooling furnace disclosed in the non-patent document 1.
Figure 2:
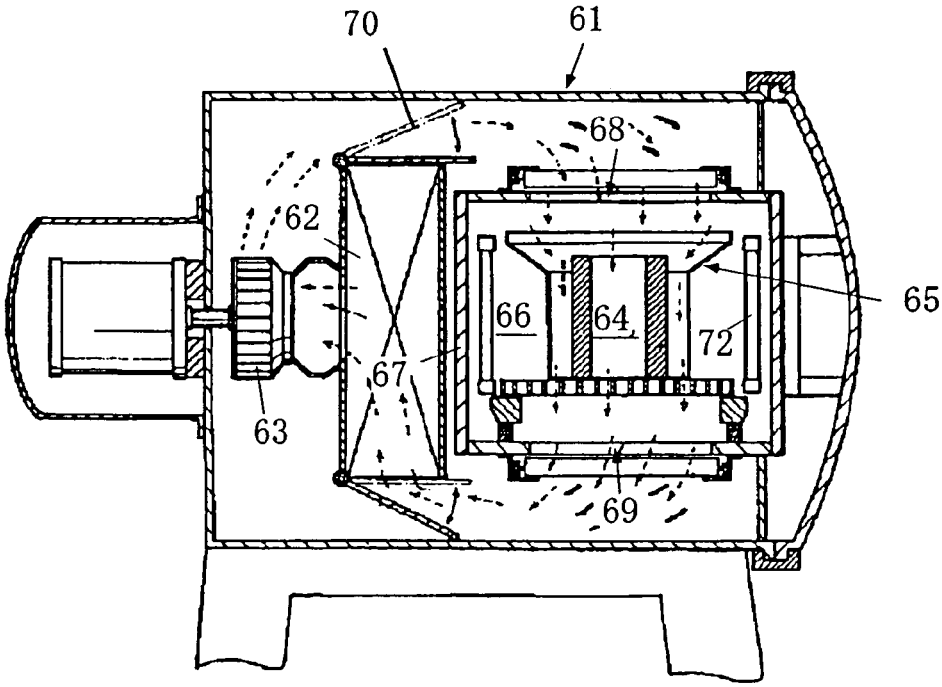
FIG. 2 PRIOR ART
FIG. 2 is a view illustrating a configuration in a method of promoting gas circulation and cooling disclosed in the patent document 1.

Explanation will be hereinbelow made of preferred embodiments of the present invention with reference to the accompanying drawings. It is noted that like reference numerals are used to denote like parts throughout the drawings in order to avoid duplicative explanation.

Figure 3:
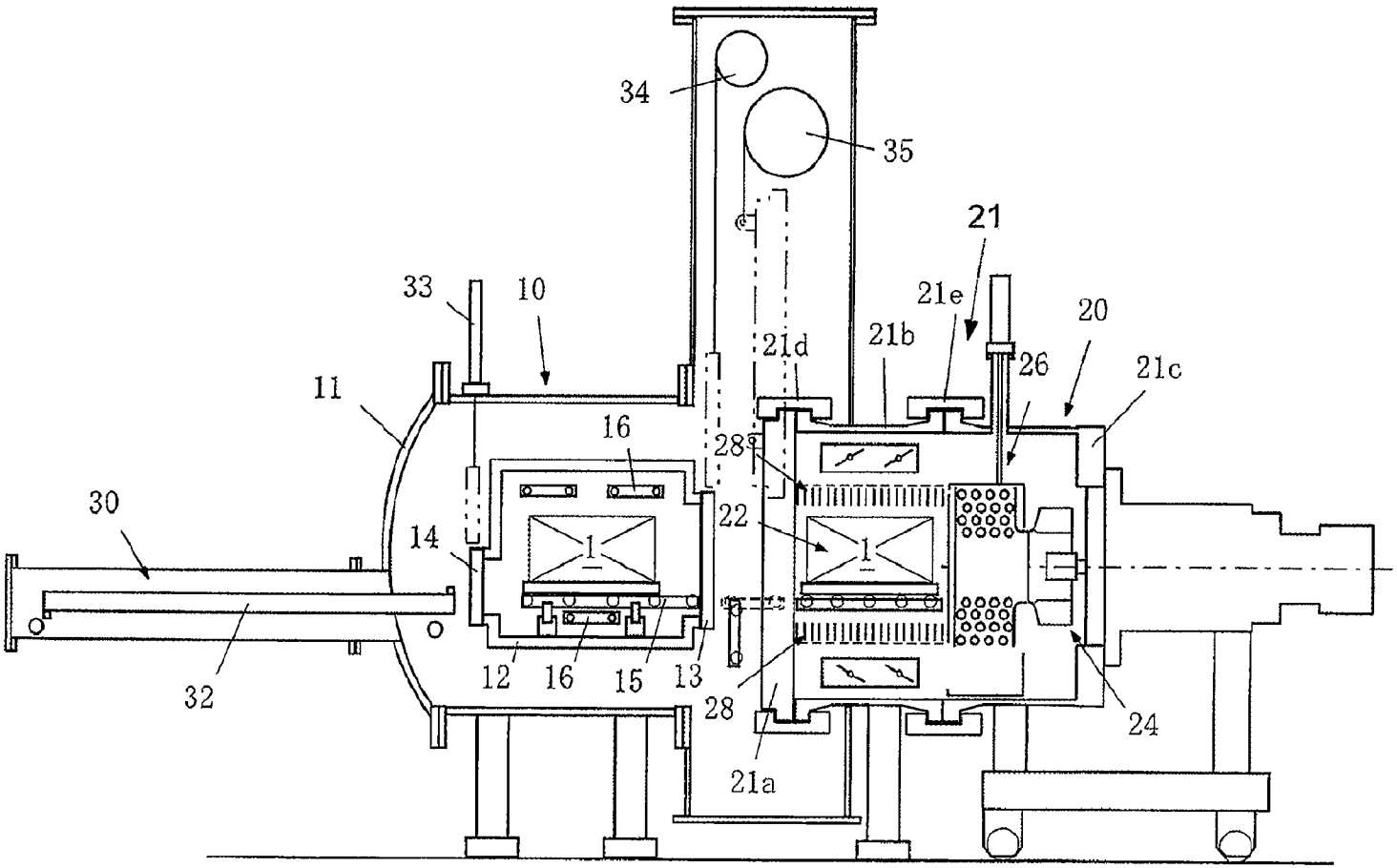
FIG. 3 is a view illustrating an entire configuration of a gas cooling type vacuum heat-treating furnace in an embodiment of the present invention.

Referring to FIG. 3 which shows an entire configuration of a gas cooling type vacuum heat treating furnace according to the present invention, the vacuum heat treating furnace according to the present invention is of a multiple chamber type, and incorporates a vacuum heating furnace 10, a gas cooling furnace 20 and a shifter 30.

The vacuum heating furnace 10 has a function of depressurizing an article 1 to be heat-treated, thereafter recharging inert gas or the like and heating the article 1 to be heat-treated. The gas cooling furnace 20 has a function of cooling the thus heated article 1 to be heat-treated with pressurized circulation gas 2. The shifter 30 has a function of shifting the article to be heat-treated between the vacuum heating furnace 10 and the gas cooling furnace 20. It is noted that the present invention should not be limited to the multi-chamber type heat treating furnace, but it may be applied to a single chamber furnace in which vacuum heating and gas cooling are both carried out in a single chamber.

The vacuum heating furnace 10 comprises a vacuum vessel 11 adapted to be vacuum-evacuated, a heating chamber 12 set therein with the article 1 to be heat-treated, a front door 13 through which the article 1 to be heat-treated is taken into and out, a rear door 14 for closing an opening through which the article 1 to be heat-treated in the heating chamber is shifted, a carriage 15 for carrying thereon the article 1, so as to be horizontally movable, a heater 16 for heating the article 1, and the like. With this configuration, the inside of the vacuum vessel 11 may be depressurized into vacuum, and the article 1 may be heated up to a predetermined temperature.

The shifter 30 is composed of a transfer rod 32 for shifting the article 1 between the vacuum heating furnace 10 and the gas cooling furnace 20, a rear door elevating device 33 for moving up and down the rear door 14 which is therefore opened and closed, and an intermediate door elevating device 34 for elevating an intermediate heat-insulation door 21*a* of the gas cooling furnace 20, which is therefore opened and closed. In this example, although the transfer rod 32 is driven through a pinion and a rack, and the rear door elevating device 33 is a direct-acting cylinder while the intermediate door elevating device 34 is a winch, the present invention should not be limited to this configuration, but other drive mechanisms may be also used. With this configuration, in a condition in which the rear door 14, the front door 13 and the intermediate heat-insulation door 21*a* are opened, the article 1 to be heat-treated may be horizontally shifted by the transfer rod 32 between the vacuum heating furnace 10 and the gas cooling furnace 20.

Figure 4A:
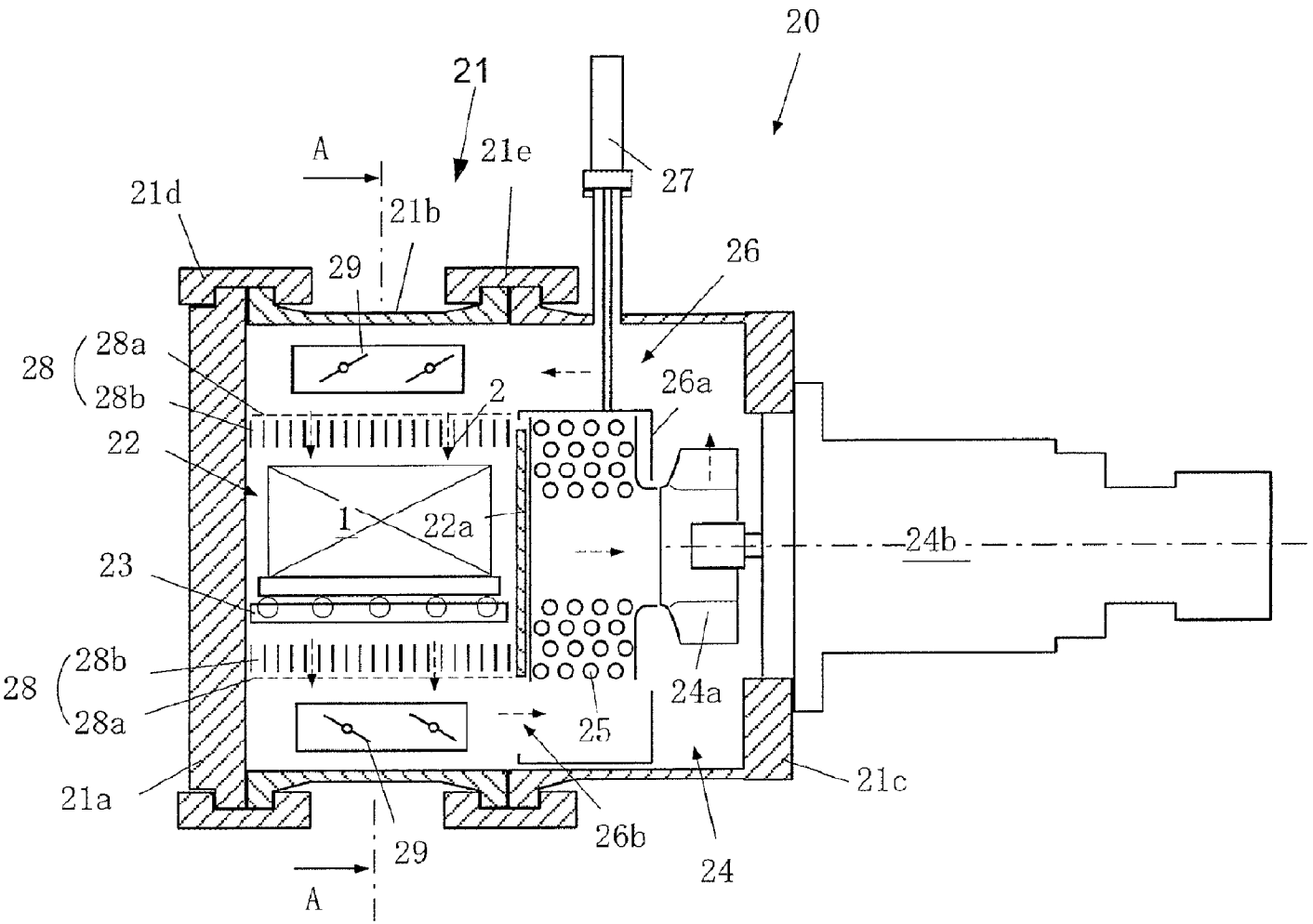
FIGS. 4A and 4B illustrate partly enlarged views of FIG. 3.
Figure 4B:
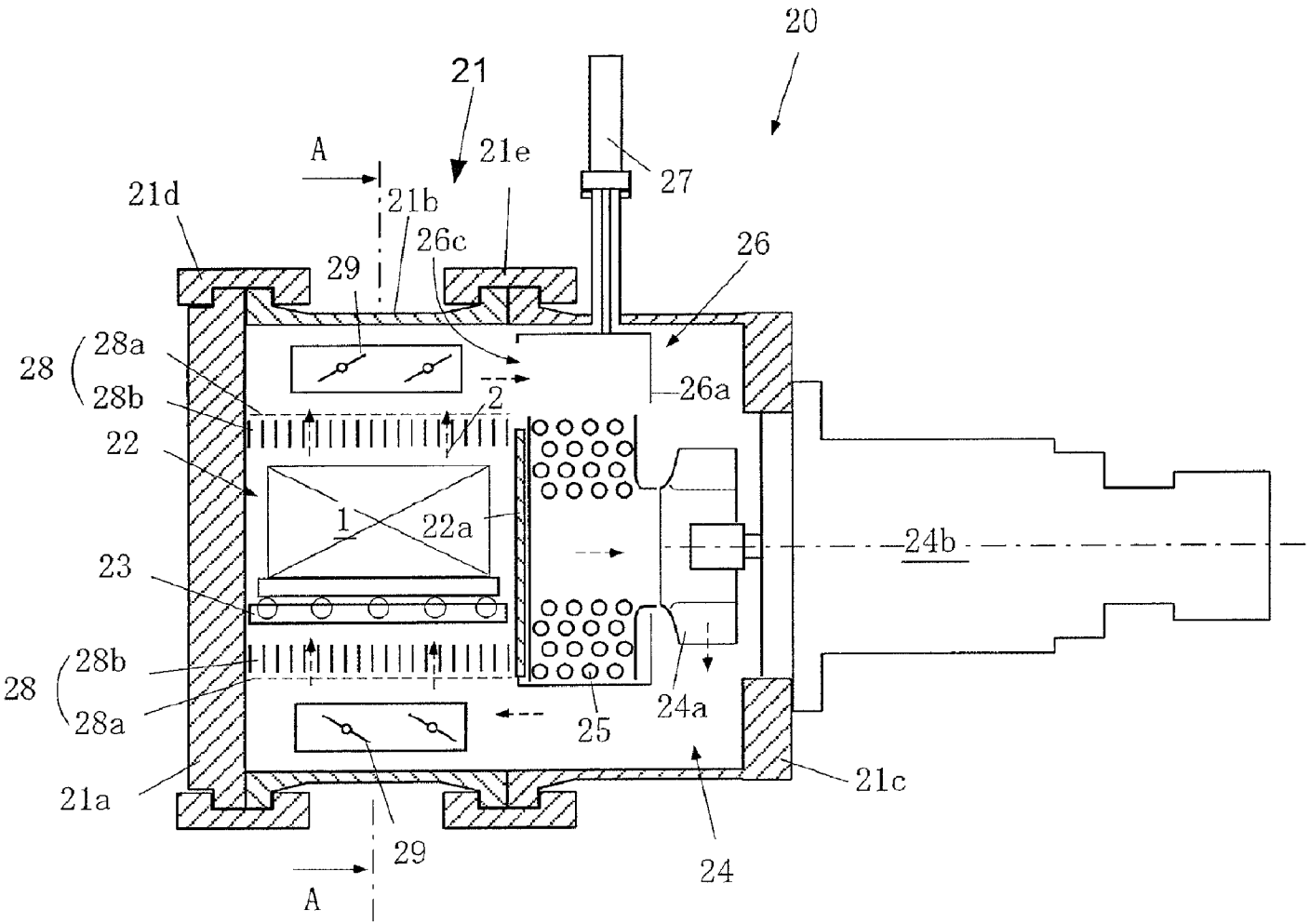
Figure 5:
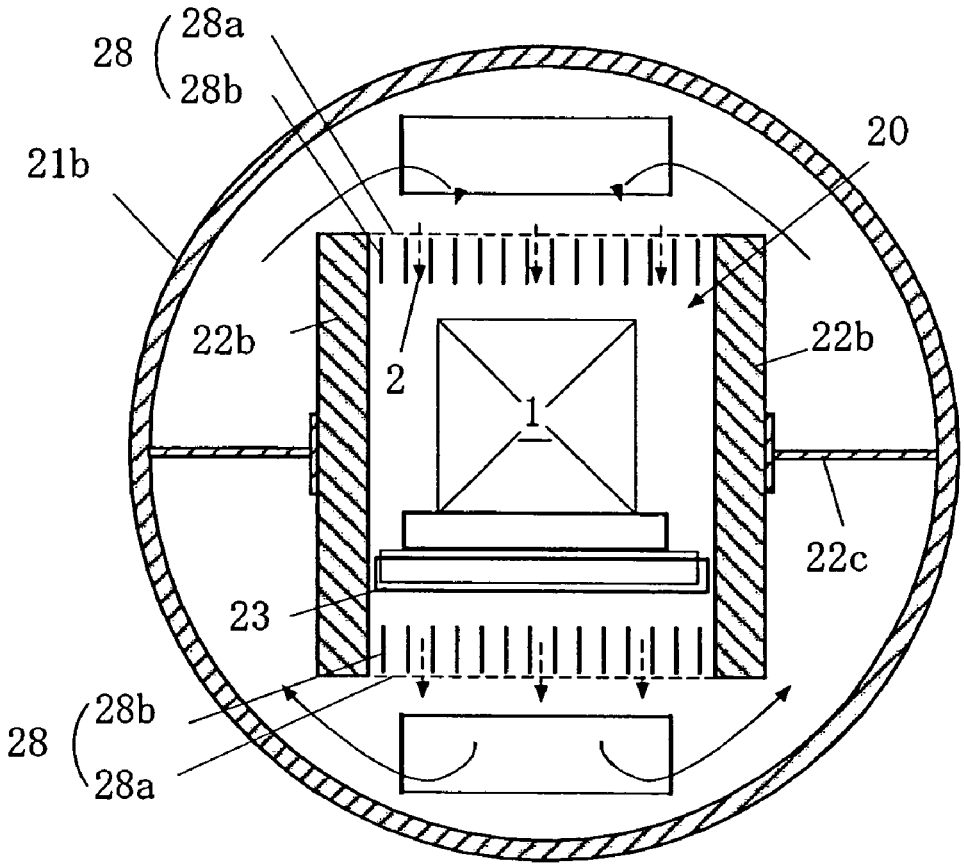
FIG. 5 is a sectional view along line A-A in FIG. 4.

FIG. 4 is a partly enlarged view of FIG. 3, and FIG. 5 is a sectional view along line A-A in FIG. 4. As shown in FIGS. 3 to 5, the gas cooling furnace 20 incorporates a vacuum vessel 21, a cooling chamber 22, a gas cooling and circulating device 24 and a gas direction switching device 26 and straighteners 28.

The vacuum vessel 21 is composed of the intermediate heat insulation door 21*a* which is provided being opposed to the front door 13 of the vacuum heating furnace 10, a cylindrical vessel barrel portion 21*b* for receiving therein the article 1, a circulating portion 21*c* for accommodating therein the gas cooling circulation device 24, and clutch rings 21*d*, 21*e* which may be opened and closed in a gas-tight manner. With this configuration, by opening the clutch ring 21*e* so as to retract the vessel barrel portion 21*b* rightward as viewed in FIG. 3, the article 1 to be heat-treated may be directly set in the vessel barrel portion 21*b*. Further, the intermediate insulation door 21*a* and the circulating portion 21*c* are coupled to the vessel barrel portion 21*b* in a gas-tight manner by means of the clutch rings 21*d*, 21*e*, and pressurized cooling gas (argon, helium, nitrogen, hydrogen or the like) is fed into the vessel barrel portion 21*b*, thereby it is possible to use the pressurized gas for cooling.

The cooling chamber 22 is provided in the center part of the vessel barrel portion 21*b*, adjacent to the vacuum heating furnace 10. The cooling chamber 22 is partitioned on the vacuum heating furnace side by the intermediate insulation door 21*a*, on the gas cooling circulation device side and at opposite side surfaces by heat insulation walls 22*a*, 22*b* which are gas-tight. Further, the cooling chamber 22 is opened at upper and lower ends, and defines therein a gas passage having a uniform cross-sectional area, in a vertical direction. Further, the cooling chamber 22 defines therein a cooling zone, and the article 1 which is a small-sized metal component such as a gear, a shaft, a blade or a vane of a jet engine or a bolt, is set in a tray or a basket, and is then located stationarily on a carriage 23 which is located in the center part of the cooling chamber 22 and which is gas-permeable.

The carriage 23 is located at the same height as that of the carriage 15 in the vacuum heating furnace 10, and may freely move on rollers incorporated therein. Further, horizontal partition plates 22*c* are provided between the vessel barrel portion 21*b* and the heat insulation wall 22*b*, as shown in FIG. 5, so as to partition gas in the upper and lower parts of the cooling chamber 22 in a gas-tight manner.

The gas cooling and circulating device 24 is composed of a cooling fan 24*a* located adjacent to the cooling chamber 22, for sucking and pressurizing gas having passed through the cooling chamber 22, and a heat-exchanger 25 for indirectly cooling the gas sucked into the cooling fan 24*a*. The cooling fan 24*a* is rotated by a cooling fan motor 24*b* attached to the circulating portion 21*c* of the vacuum vessel 21, sucking the gas in its center part and discharging the gas from its outer peripheral part. The heat-exchanger 25 is composed of, for example, cooling fin tubes which are interiorly water-cooled. With this configuration, the circulation gas which has been cooled through the heat-exchanger 25 may be sucked into the center portion of the cooling fan 24*a* and the gas discharged from the outer peripheral part thereof and flowing through the cooling chamber 22 in a vertical direction may be cooled and circulated.

The gas direction switching device 26, comprises, in this example, a hollow cowling 26*a* surrounding the heat-exchanger 25 with a space therebetween, and an elevating cylinder 27 for moving the cowling 26*a* up and down. The cowling 26*a* has a lower suction port 26*b* which is communicated with the lower part of the cooling chamber 22 at a downward position as shown in FIG. 4A and an upper suction port 26*c* which is communicated with the upper part of the cooling chamber 22 at an upward position as shown in FIG. 4B.

With this configuration, the upper suction port 26*c* and the lower suction port 26*b* are alternately communicated with the suction side of the cooling fan 24*a* so as to alternately switching the directions of the gas flowing through the cooling chamber 22 in vertical directions, and accordingly, differences in flowing velocity among positions of the articles 1 to be heated which are arranged in order are decreased so as to restrain distortion of the articles 1 to be heat-treated in its entirety.

The upper and lower straighteners 28 are provided at the upper and lower ends of the cooling chamber 22, having a function of equalizing a velocity distribution of the gas passing through the cooling chamber 22.

Each of the upper and lower rectifiers 28 is composed of a uniform distribution part 28*a* and a straightening part 28*b* which are stacked one upon another. It is noted that the straightener 28 may have both functions of a uniform distribution portion and a straightening portion.

The uniform distribution part 28*a* comprises a plurality of pressure loss inducing means which are uniformly arranged in a direction orthogonal to a gas stream 2 (that is, a horizontal direction in this example) in order to exert a flow resistance which causes the gas stream 2 to have a pressure loss coefficient of not less than 0.1 in order to aim at uniformly distributing flow velocities. The pressure loss means are for example perforations so as to exert a flow resistance in order to aim at uniformly distributing flowing velocities. The higher the ratio of the flow resistance (pressure loss) with respect to the total pressure loss of the gas stream 2, the higher the effect of the Uniform distribution, the flow resistance (pressure loss) of the upper and lower pressure loss inducing means is set to a value which is not less than a pressure loss coefficient 0.1 of the upward gas stream 2.

It is noted that the relationship among a pressure loss coefficient ζ, a loss head h, a flowing velocity V and the gravitational acceleration g is exhibited by the following equation;

$$h=\zeta\cdot V^2/(2\cdot g) \quad (1)$$

The straightening part 28*b* is composed of, for example, a plurality of straightening grids which are arranged in a lattice-like configuration, and which straighten the flowing directions of the gas stream 2 having passed through the uniform distribution part 28*a* so as to equalize the directions of the gas stream.

With this configuration, the flowing velocity distribution is made to be uniform by the plurality of pressure loss inducing means, and the flowing directions of the gas stream are equalized by the plurality of straightening grids.

Further, in the gas cooling type vacuum heat-treating furnace according to the present invention, auxiliary distribution mechanisms (29) (for example, blow-in vanes) for guiding the direction of the gas stream introduced into and from the cooling chamber 22 are provided above and below the cooling chamber 22, and accordingly, even though the upper and lower areas of the cooling chamber are large, the directions of the gas stream toward a plurality of positions are optimized so as to enhance the uniformity of the stream.

With the configuration as stated above, since the cooling chamber 22 is blocked at its upper and lower ends with the upper and lower straighteners 28 so as to equalize the flowing velocity distribution of the gas passing therethrough, variation in the flowing velocity of the gas passing through the cooling zone is restrained to a minimum value, thereby it is possible to blow non-turbulent cooling gas onto the article 1 to be heat-treated. The cooling gas may also uniformly discharged from the outlet portion, after passing through the article 1 to be heat-treated, and accordingly, there is exhibited such an enforcement that the cooling gas uniformly pass through the center part of the article 1 to be heat-treated, thereby it is possible to reduce distortion of the article 1 to be heat-treated in its entirety.

As stated above, there may be exhibited the following excellent advantages: the gas cooling type vacuum heat-treating furnace according to the present invention may cool the article to be heat-treated at a high speed during cooling so as to uniformly supply cooling gas onto the article over its entirety, and further, both upward and downward cooling gases may be straightened so as to have both uniform velocity and uniform direction in order to reduce distortion of the article.

Figure 6:
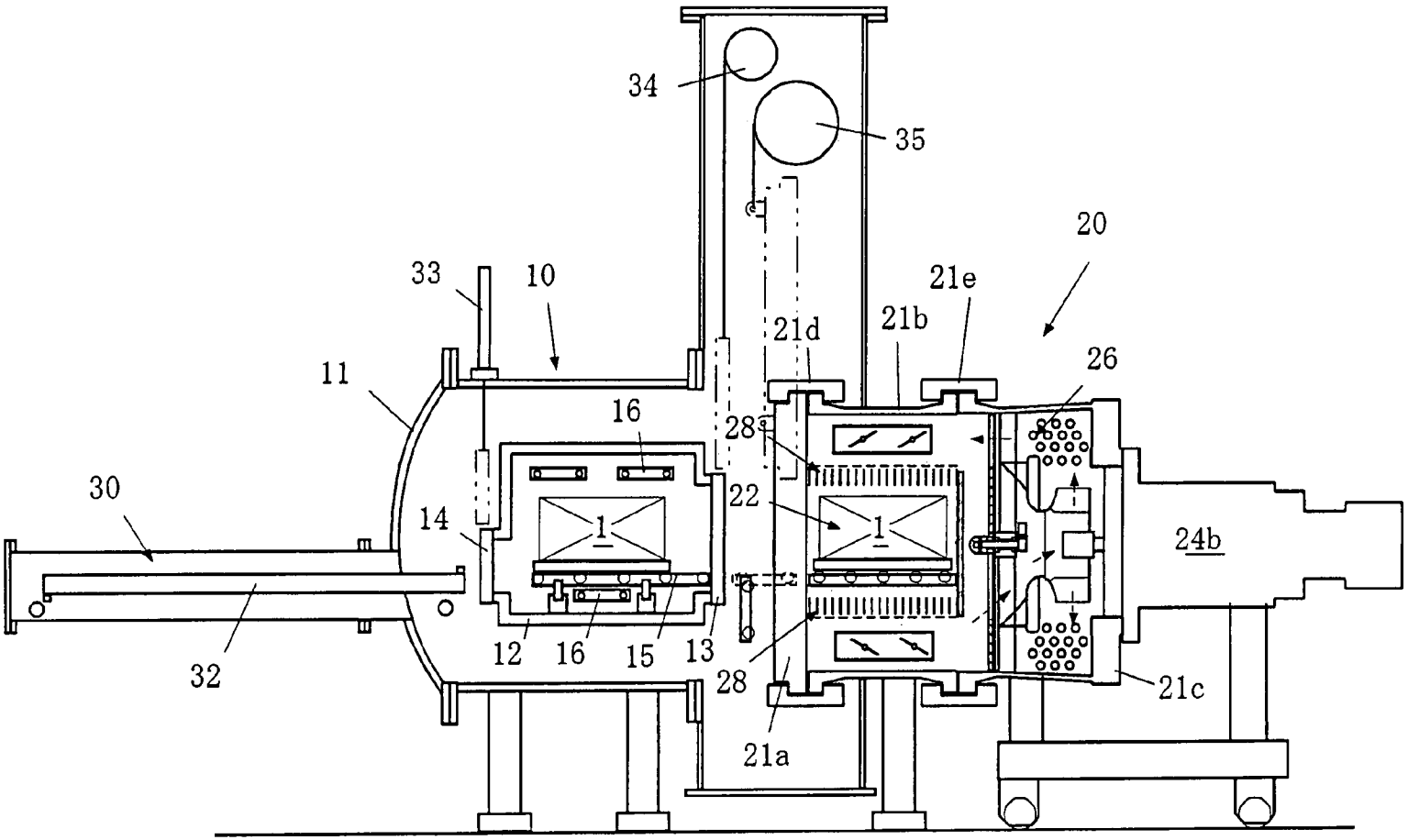
FIG. 6 is a view illustrating an overall configuration of a vacuum heat treating furnace incorporated a cooling gas direction switching device in an embodiment of the present invention.

FIG. 6 shows an entire configuration of a vacuum heat-treating furnace incorporating the cooling gas direction switching device according to a first embodiment of the present invention. The vacuum heat-treating furnace is of a multi-chamber type, comprising a vacuum heating furnace 10, a gas cooling furnace and a shifter 30, the vacuum heating furnace 10 and the shifter 30 have configurations similar to those shown in FIG. 3 as stated above.

Figure 7:
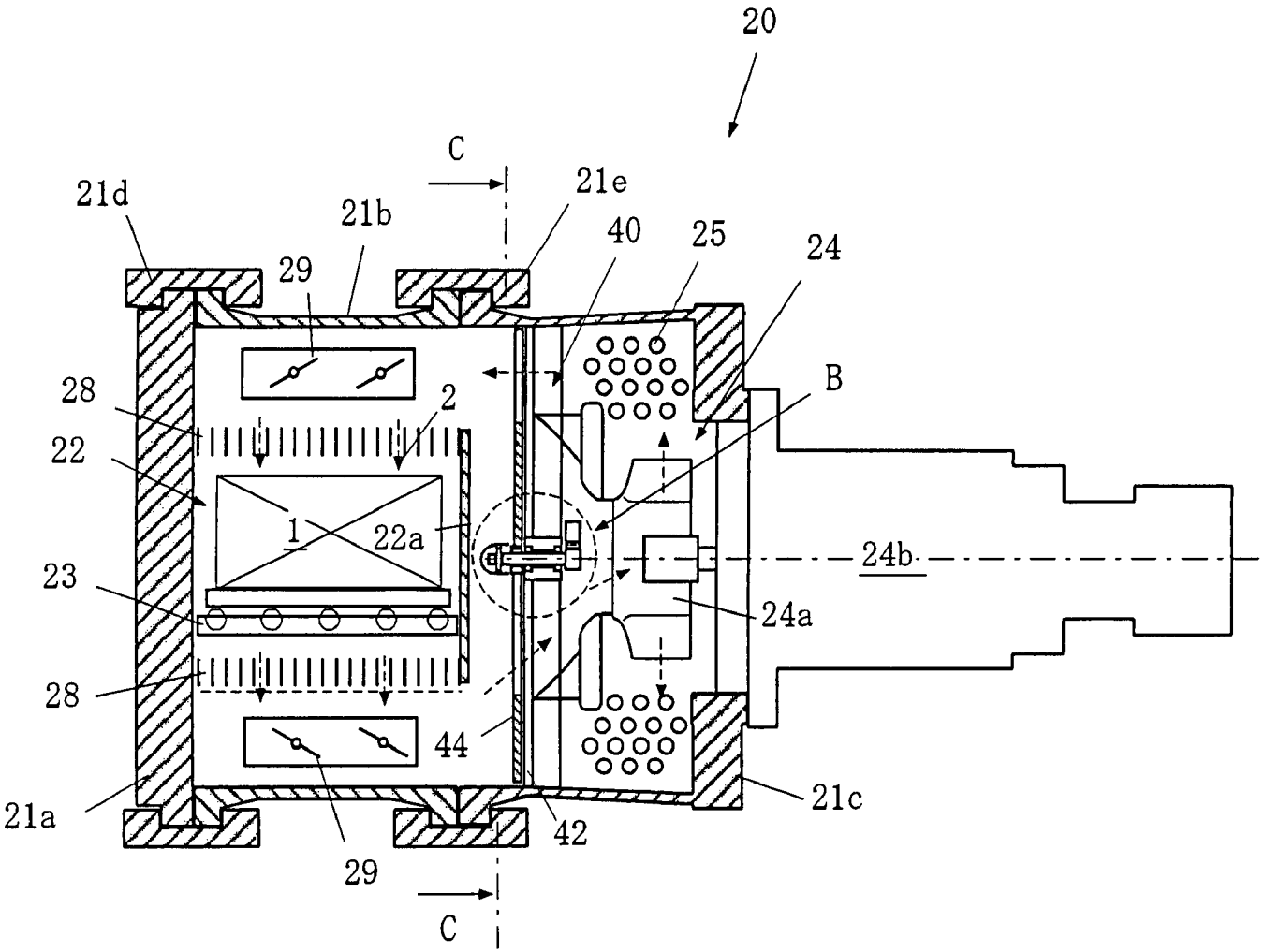
FIG. 7 is a partly enlarged view of FIG. 6.

FIG. 7 is a partial enlarged view of FIG. 6. Referring to FIGS. 6 and 7, the cooling furnace 20 incorporates a vacuum vessel 21, a cooling chamber 22, a gas cooling and circulating device 24, a cooling gas direction switching device 40, straighteners 28, and auxiliary distribution mechanisms 29. The vacuum vessel 21, the cooling chamber 22, the straighteners 28 and the auxiliary distribution mechanism 29 have configurations similar to those shown in FIGS. 4 and 5 as stated above.

The gas cooling and circulating device 24 is composed of a cooling fan 24*a* arranged adjacent to the cooling chamber 22, for sucking and pressurizing gas which has passed through the cooling chamber 22, and a heat-exchanger 25 for indirectly cooling the gas discharged from the cooling fan 24*a*. The cooling fan 24*a* is rotated by a cooling fan motor 24*b* attached to a circulation porition 21*c* of the vacuum vessel 21, sucking the gas through the center part thereof and discharging the gas from the outer peripheral part thereof. The heat-exchanger 25 is composed of, for example, cooling fin tubes which are interiorly water-cooled. With this configuration, the circulation gas discharged from the outer peripheral part is cooled by the heat-exchanger 25 so as to cool and circulate the gas passing through the cooling chamber in a vertical direction.

Figure 8:
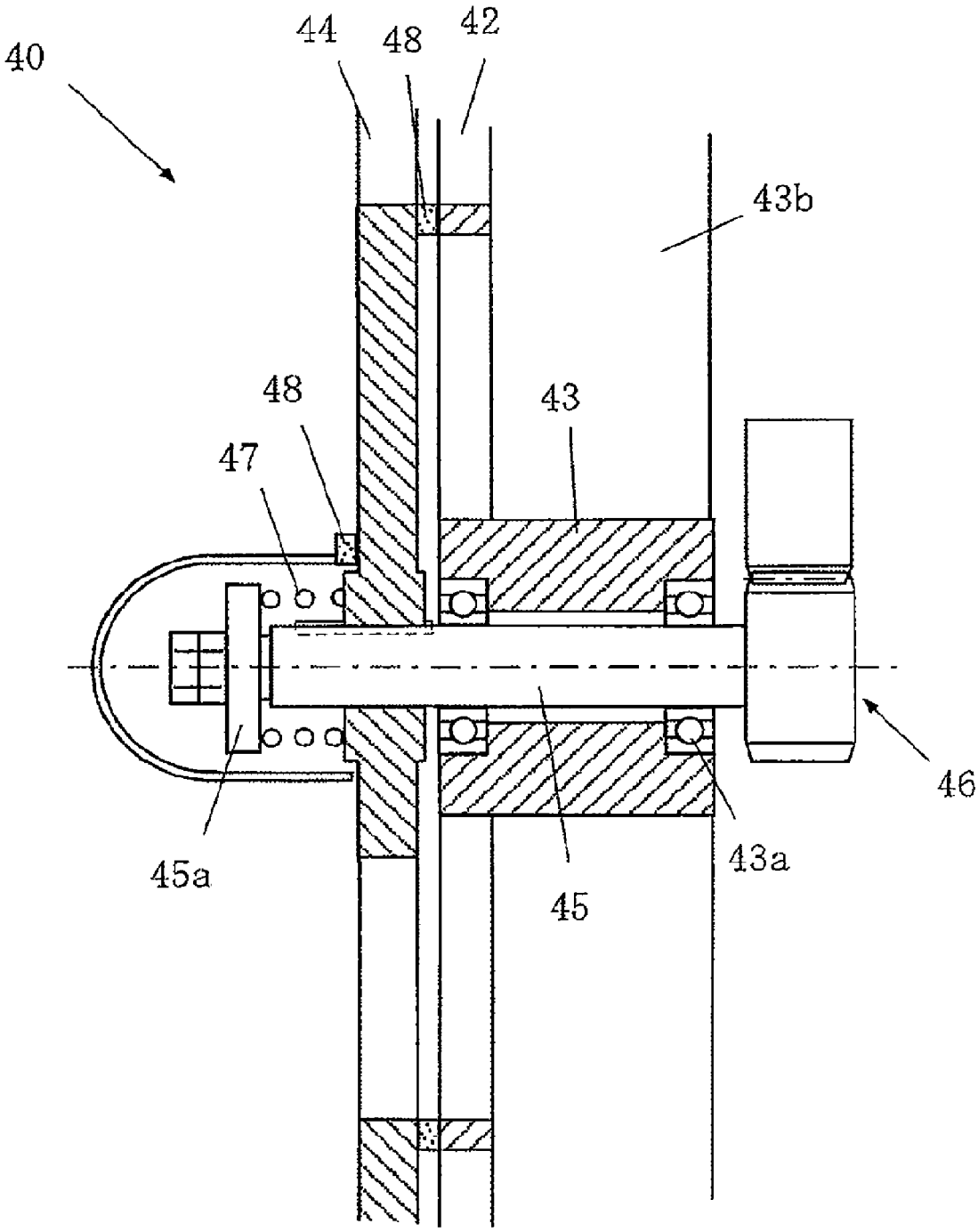
FIG. 8 is a partly enlarged view illustrating a portion B in FIG. 7.

Referring to FIG. 8 which is an enlarged view illustrating a part B in FIG. 7, the cooling gas direction switching device 40 is composed of a stationary partition plate 42, a rotary partition plate 44 and a rotary drive device 46

The stationary partition plate 42 partitions between the cooling chamber 22 and the gas cooling and circulating device 24, and shuts off therebetween. The rotary partition plate 44 is rotated along the outer surface of the stationary partition plate 42 by the rotary drive device 46, coaxial with the cooling fan 24 in this example. The rotary drive device 46 is composed of a rack and a pinion in this example, so as to rotate the rotary partition plate 44 by a half of a revolution in order to turn the same upside down. The rack may be directly driven by a pneumatic or hydraulic cylinder or the like. Further, the present invention should not be limited to this configuration, but any drive device other than the above-mentioned rotary drive device may be used.

The rotary partition plate 44 is provided, in its center part, with a bearing housing 43 incorporating therein a bearing 43*a*. The bearing housing 43 is supported by support frams 43*b* from the circulation portion 21*c* of the vacuum vessel 21.

The rotary partition plate 44 is fixed in its center part to the rotary shaft 45, and is restrained by a key fitted in its center part from being rotated, relative to the rotary shaft 45. The rotary shaft 45 is supported by the bearing 43*a*, coaxial with the cooling fan 24*a*. A compression spring 47 is held between an axial end (the support plate 45*a* on the left end as shown in the figure), and the rotary partition plate 44, being compressed therebetween, so as to always urge the rotary partition plate 44 toward the stationary plate 42 in order to reduce a gap therebetween. Thus, with this additional loading its function may be enhanced.

A seal members is applied to an end surface of the above-mentioned horizontal partition plate 22*c* (Refer to FIG. 5) and an end surface of the stationary partition plate 42 for sealing a gap between the rotary partition plates and with respect to the rotary partition plate 44. The seal members 48 is made of lead brass, graphite or the like, which may reduce leakage and allow smooth motion.

Figure 9A:
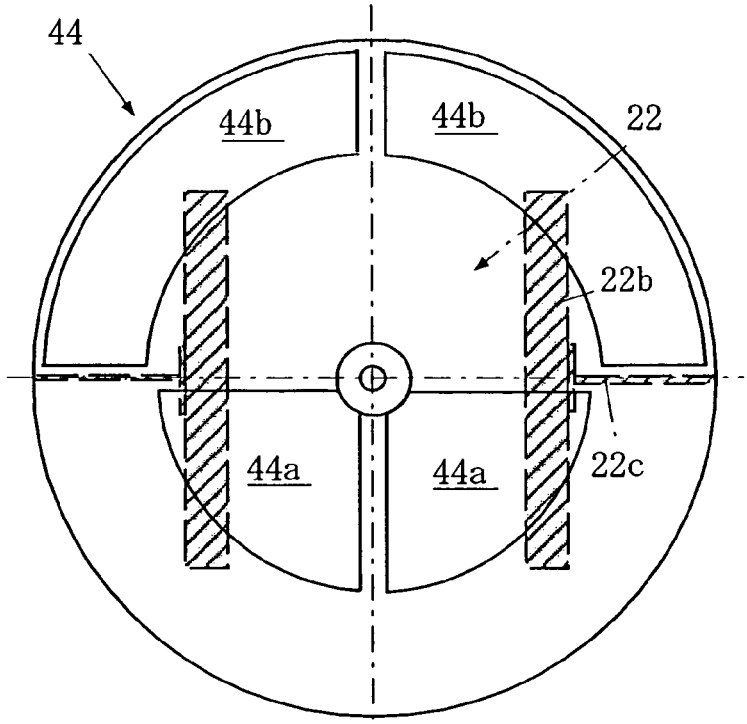
FIGS. 9A and 9B are sectional views along line C-C in FIG. 7.
Figure 9B:
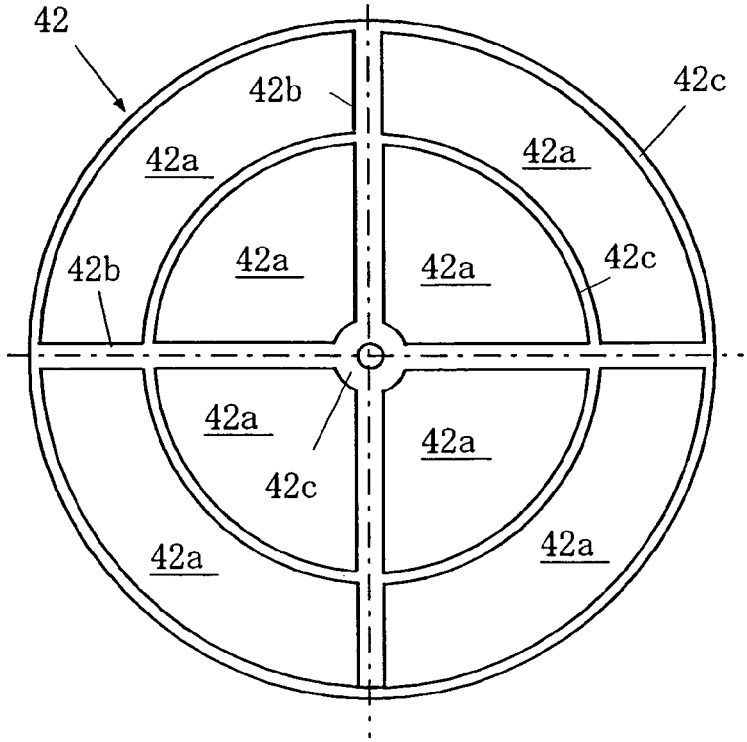

FIG. 9A and FIG. 9B are sectional view along line C-C in FIG. 7. That is, FIG. 9A is a section view along line C-C, that is a front view which shows the rotary partition plate 44, and FIG. 9B is a section view from which the rotary partition plate 44 is removed, that is a front view which shows the stationary partition plate 42.

The stationary partition plate 42 has an opening 42*a* piercing therethrough, substantially over the entire surface thereof. That is, in this example, it is composed of thin radial parts 42*b* which are located at the same positions as those of the support frames 43*b* and which are extended radially, and thin ring-like circular parts 42*c* which are located at an outermost peripheral position, a center position and an intermediate position. It is noted, as shown in this figure, that the above-mentioned bearing housing 43 is attached to the center circular part 42*c*. It should be noted here that the position of the opening 42*a* is not limited to this example, but is located any position where it has an area as large as possible.

The rotary partition plate 44 has a suction opening 44*a* and a discharge opening 44*b* which are partly communicated with a suction port and a discharge port of the gas cooling and circulating device.

In the first embodiment shown in FIGS. 9A and 9*b*, the cooling chamber 22 has a gas passage vertically piercing therethrough. When the gas flows downward in the cooling chamber 22, the suction opening 44*a* is communicated only with the lower part of the cooling chamber while the discharge opening 44*b* is communicated only with the upper part of the cooling chamber, but when the gas flows upward, the suction opening 44*a* is communicated only with the upper part of the cooling chamber while the discharge opening 44*b* is communicated only with the lower part of the cooling chamber.

It is noted in this example that the suction opening 44*a* has a substantially half-circular shape while the discharge opening 44*b* has a substantially half-sector shape, and they are arranged opposite to each other with respect to a horizontal axis (the above-mentioned horizontal partition plate 22*c*).

With this configuration, of a furnace body interior area A which partitions between the cooling chamber 22 and the gas cooling and circulating device 24, halves are allocated respectively to the suction port and the discharge port of the gas cooling circulation device, and further, halves of each of the suction port and the discharge port are allocated to upper and lower parts thereof, thereby it is possible to set the suction opening 44*a* and the discharge opening 44*b* to about a quarter of the furnace body interior area A. Thus, the flowing velocity of the gas passing therethrough may be lowered, thereby it is possible to reduce pressure loss.

Further, between the stationary partition plate 42 and the gas cooling and circulating device 24, the entire interior surface is communicated with the suction port of the gas cooling and circulating device while the entire outer surface is communicated with the discharge port of the gas cooling and circulating device, and accordingly, by taking a sufficient gap between the discharge portion and the suction port, the gas can flow around into the opposite surfaces even though it is opened by a half area, thereby it is possible to effectively utilize the heat-exchanger.

With the configuration of the present invention as stated above, only by rotating the rotary partition plate along the outer surface of the stationary partition plate which partitions between the cooling chamber and the gas cooling and circulating device, the flowing directions of the gas passing through the cooling chamber may be alternately switched, and further, since the rotary partition plate is rotated in a direction perpendicular to the flowing directions, the flowing directions may be smoothly switched without less affection by gas pressure even though high pressure gas (gas having a high density) flows.

Further, since rotary partition plate has the suction opening and the discharge opening which are partly communicated with the suction port and the discharge port of the gas cooling and circulating device, variation in opening area and a difference in opening area between the suction port and the discharge port can hardly be caused, and accordingly, the gas cooling may be stably carried out. Further, since the configuration is simple and the flowing directions may be switched over only by a single drive unit, a large opening area may be ensured.

It is noted that although explanation has been made of the upward and downward flowing of the gas in the above-mentioned embodiment, the direction of the rotary partition plate may be turned by an Angle of 90 deg., and the straightener in the cooling chamber may be attached to a side surface (left and right), so as to constitute a switching mechanism for leftward and rightward flowing directions.

Further, although explanation has been made of the heat-exchanger 25 which is arranged in the passage between the outlet of the cooling fan 24 and the stationary partition plate 42, the heat-exchanger may be arranged, instead, outside of the rotary partition plate 44 (the cooling chamber 22 side).

Figure 10A:
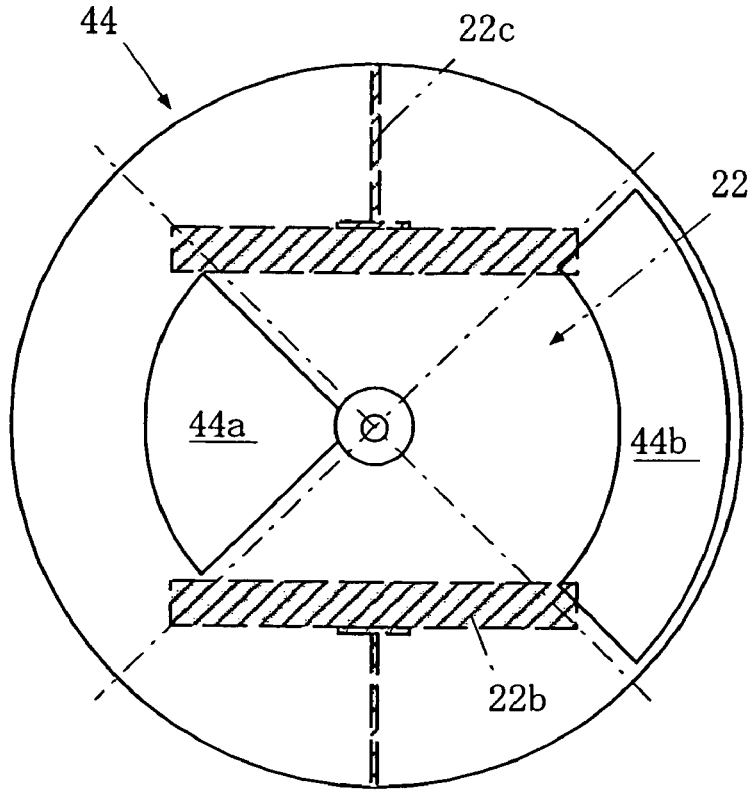
FIGS. 10A and 10B are sectional views, similar to FIG. 9, illustrating a cooling gas direction switching device in a second embodiment of the present invention.
Figure 10B:
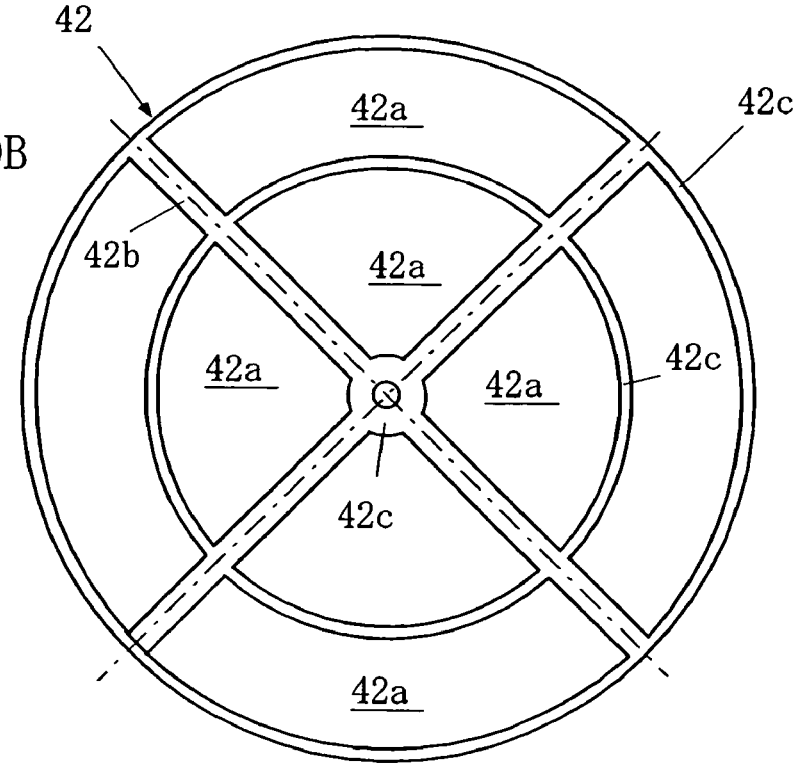

FIGS. 10A and 10B are sectional views which show a cooling gas direction switching device in a second embodiment of the present invention, similar to FIGS. 9A and 9B. FIG. 10A is a sectional view along line C-C, that is, a front view illustrating the rotary partition plate 44 while FIG. 10B is a sectional view from which the rotary partition wall is removed, that is, a front view illustrating the stationary partition plate 42.

In this second embodiment, the cooling gas direction switching device is capable of coping with both vertically flowing the gas (vertical flow) and horizontally flowing the gas (horizontal flow).

That is, in this example, the suction opening 44*a* has a substantially quarter circle shape while the discharge opening 44*b* has a substantially quarter sector shape, which are arranged on opposite sides of a horizontal axis (the horizontal partition plate 22*c* as stated above).

In this embodiment, when the gas vertically flows in the cooling chamber 22, the suction opening 44*a* is selectively communicated only with the lower part or the upper part of the cooling chamber 22 while the discharge opening 44*b* is selectively communicated only with the upper part or the lower part of the cooling chamber 22, similar to FIGS. 9A and 9B. Further, as shown in FIG. 10A, the opening position is set as follows: when the gas horizontally flows in the cooling chamber 22, the suction opening 44*a* is selectively communicated only with either one of both sides of the cooling chamber 22 while the discharge opening 44*b* is selectively communicated only with the other one of both sides of the cooling chamber 22.

With this configuration, only by rotating the rotary partition plate along the outer surface of the stationary partition plate which partitions between the cooling chamber and the gas cooling and circulating device, the directions of the gas flowing through the cooling chamber may be optionally changed over, vertically and horizontally.

It is noted that the cooling gas direction switching device may be used not only in a device in which a heating chamber and a cooling chamber are separated from each other, but also in a furnace having a single chamber in which both heating and cooling may be carried out.

As stated above, the cooling gas direction switching device in the vacuum heating furnace according to the present invention can substantially prevent from being affected by air pressure, and accordingly may smoothly change over the flowing directions (gas passages) of the cooling gas. Thus, variation in opening area and difference in opening area between the suction port and the discharge port can hardly occur so that gas cooling may be stably carried out with a simple configuration in which the flowing directions of the gas may be switched by a single drive unit, thereby it is possible to exhibit excellent technical effects and advantage such as that a large opening area may be ensured and so forth.

It is noted that explanation has been made of the gas cooling type vacuum heat treating furnace and the cooling gas direction switching device therefor according to the present invention in the form of several embodiments, it should be understood that the scope of the patent right included in the present invention should not be limited to these embodiments. That is, the scope of the patent right according to the present invention includes several improvements, modifications and equivalents within the technical scope which are defined by the appending claims.

The invention claimed is:

1. A gas cooling type vacuum heat-treating furnace incorporating a gas cooling furnace for cooling an article which has been heated, with pressurized circulation gas, characterized in that the gas cooling furnace comprises a cooling gas surrounding a cooling zone where the article to be heat-treated is stationarily set, and defining therein a vertical gas passage having a constant cross-sectional area, a gas cooling and circulating device for cooling and circulating gas vertically flowing in the cooling chamber, a gas direction switching device for switching directions of gas vertically flowing in the cooling chamber, and upper and lower straighteners blocking upper and lower ends of the cooling chamber, for causing a flowing velocity distribution of the gas passing therethrough to be uniform, wherein the gas cooling and circulating device comprises a cooling fan arranged adjacent to the cooling chamber, for sucking and pressurizing the gas having passed through the cooling chamber, and a heat-exchanger for indirectly cooling the gas sucked in to the cooling fan, and wherein the gas direction switching device incorporates a hollow cowling surrounding the heat-exchanger, being spaced therefrom, and an elevating cylinder for moving the cowling up and down, the cowling has a lower suction port which is communicated with a lower part of the cooling chamber at a downward position, and an upper suction port which is communicated with an upper part of the cooling chamber at an upward position.

2. A gas cooling type vacuum heat-treating furnace as set forth in claim 1, characterized in that each of the upper and lower straighteners comprise a uniform distribution portion and a straightening portion which are stacked one upon another, or have both functions of a uniform distribution portion and a straightening portion, the uniform distribution portion has a plurality of pressure loss inducing means uniformly arranged in a direction orthogonal to an upward gas stream, for applying a flow resistance corresponding to a pressure loss coefficient of not less than 0.1, to the upward gas stream so as to aim at uniformly distributing flow velocities, and the straightening portion has a plurality of straightening grids for straightening flowing directions of the upward gas stream having passed through the uniform distribution portion.

3. A gas cooling type vacuum heat-treating furnace as set forth in claim 1, characterized by further comprising auxiliary distribution mechanisms for guiding directions of gas streams flowing into the cooling chamber upward and downward from the gas direction switching device.

4. A cooling gas direction switching device in a gas cooling type vacuum heat treating furnace comprising a cooling chamber surrounding a cooling zone in which an article to be heat-treated is stationarily set, and a gas cooling and circulating device for cooling and circulating gas passing through the cooling chamber, the heat-treating furnace being adapted to cool the heated article to be heat-treated with pressurized circulation gas, characterized by a stationary partition plate partitioning between the cooling chamber and the gas cooling and circulating device, and a rotary partition plate which is rotated along an outer surface of the stationary partition plate, and characterized in that the stationary partition plate includes at least one opening passing therethrough which allows gas to circulate between a suction port and a discharge port of the gas circulating device, the rotary partition plate having a suction opening and a discharge opening which are partly communicated with the suction port and discharge port.

5. A gas direction switching device in a gas cooling type vacuum heat treating furnace as set forth in claim 4, characterized in that the cooling chamber has a gas passage vertically piercing therein, and a position of the suction opening and a position of the discharge opening are set in such a way that:

when the gas flows downward in the cooling chamber, the suction opening is communicated only with a lower part of the cooling chamber while the discharge opening is communicated only with an upper part of the cooling chamber, and when the gas flows upward in the cooling chamber, the suction opening is communicated only with the upper part of the cooling chamber while the discharge opening is communicated only with the lower part of the cooling chamber.

6. A gas direction switching device in a gas cooling type vacuum heat treating furnace as set forth in claim 4, characterized in that a position of the suction opening and a position of the discharge opening are set in such a way that:

when the gas vertically flows in the cooling chamber, the suction opening is selectively communicated only with a lower part or an upper part of the cooling chamber while the discharge opening is selectively communicated only with the upper part or the lower part of the cooling chamber, and when the gas horizontally flows in the cooling chamber, the suction opening is selectively communicated with only one of opposite sides of the cooling chamber while the discharge opening is selectively communicated with only the other of the opposite sides of the cooling chamber.

7. A gas direction switching device in a gas cooling type vacuum furnace as set forth in claim 4, characterized in that the gas cooling and circulating device comprises a cooling fan arranged adjacent to the cooling chamber, for sucking and circulating the gas having passed through the cooling chamber, and a heat-exchanger for indirectly cooling the gas discharged from the cooling fan.

* * * * *